US010259688B1

(12) United States Patent
Dahlin et al.

(10) Patent No.: US 10,259,688 B1
(45) Date of Patent: Apr. 16, 2019

(54) V-SLING WITH HOOK POSITIONING ADAPTER

(71) Applicant: MUMSER, INC., Columbia, MD (US)

(72) Inventors: Frederick R. Dahlin, Columbia, MD (US); John T. Pedersen, Cambridge, NY (US); Palmer P. Kauffman, York, PA (US)

(73) Assignee: Mumser, Inc., Columbia, MD (US)

( * ) Notice: Subject to any disclaimer, the term of this patent is extended or adjusted under 35 U.S.C. 154(b) by 415 days.

(21) Appl. No.: 14/079,047

(22) Filed: Nov. 13, 2013

(51) Int. Cl.

| | |
|---|---|
| ***B66C 1/34*** | (2006.01) |
| ***B66C 1/14*** | (2006.01) |
| ***B66C 1/12*** | (2006.01) |
| ***B66C 1/18*** | (2006.01) |

(52) U.S. Cl.
CPC ..... *B66C 1/14* (2013.01); *B66C 1/125* (2013.01); *B66C 1/18* (2013.01)

(58) Field of Classification Search
CPC ..... B66C 1/14
USPC ..... 294/82.11, 74; 24/265 CD, 300, 600.9; 59/78, 84, 90, 93
See application file for complete search history.

(56) References Cited

U.S. PATENT DOCUMENTS

| | | | | |
|---|---|---|---|---|
| 569,448 | A | 10/1896 | Dudley | |
| 1,093,208 | A * | 4/1914 | Ryan | F16G 13/14 59/90 |
| 1,758,831 | A | 5/1930 | Haubert | |
| 2,139,294 | A | 12/1938 | Weigant | |
| 2,247,642 | A | 7/1941 | Neville | |
| 2,315,146 | A | 3/1943 | White | |
| 2,538,356 | A * | 1/1951 | Donda | 294/82.11 |
| 2,832,628 | A * | 4/1958 | Turnbull | 294/17 |
| 3,179,373 | A | 4/1965 | Cochran | |
| 3,261,636 | A * | 7/1966 | St. Pierre | F16G 15/06 294/82.1 |
| 3,348,273 | A * | 10/1967 | Hall | B60P 3/073 24/265 CD |
| 3,656,293 | A * | 4/1972 | Lowery, Sr. | F16G 15/06 59/86 |
| 3,740,079 | A * | 6/1973 | Skinner | 280/480 |
| 3,915,487 | A | 10/1975 | Zeiler | |
| 4,068,467 | A | 1/1978 | Schreyer et al. | |
| 4,249,474 | A * | 2/1981 | Archer | 294/74 |
| 4,439,067 | A * | 3/1984 | Bakk et al. | 294/82.11 |
| 4,560,534 | A * | 12/1985 | Kung et al. | 422/98 |
| D309,854 | S | 8/1990 | Smith | |
| 5,429,462 | A | 7/1995 | Anderson | |
| 5,941,665 | A * | 8/1999 | Dahlin | 410/20 |
| 6,371,543 | B1 | 4/2002 | Fujikawa et al. | |

(Continued)

*Primary Examiner* — Paul T Chin
(74) *Attorney, Agent, or Firm* — Brinks Gilson & Lione

(57) ABSTRACT

A V-sling (100) for use in winching a vehicle includes a master linking device (150) and at least two longitudinally extending flaccid leg members (114) coupled on a first end to the master linking device (150). The opposing second end of the flaccid leg members (114) are respectively coupled to a plurality of hooks (116, 116*a*). The master linking device (150) includes having a load coupling linkage (152) and a hook positioning adapter (154). The load coupling linkage (152) defines a first plane and the hook positioning adapter (154) is disposed in a second plane. The second plane is transverse to the first plane for positioning a winch hook (62) engaged therewith in a plane corresponding to the first plane.

17 Claims, 10 Drawing Sheets

(56) References Cited

U.S. PATENT DOCUMENTS

| | | | | |
|---|---|---|---|---|
| 6,648,381 | B2 * | 11/2003 | Holton | E05C 17/042 24/298 |
| 8,157,304 | B2 * | 4/2012 | Fredriksson | 294/82.11 |
| 8,256,982 | B2 * | 9/2012 | Lindsey | B66C 1/12 294/74 |
| 2007/0108731 | A1 * | 5/2007 | McBroom | B60D 1/36 280/477 |

* cited by examiner

V-SLING WITH HOOK POSITIONING ADAPTER

BACKGROUND OF THE INVENTION

This disclosure directs itself to a V-sling for use in winching vehicles. More in particular, the disclosure is directed to a V-sling having a master linking device having a load coupling linkage and a hook positioning adapter. Still further, the disclosure is directed to a master linking device with a load coupling linkage defining a first plane and a hook positioning adapter disposed in a second plane, where the second plane is transverse to the first plane, to thereby position a hook engaged with the hook positioning adapter in a plane corresponding to the first plane. Further, the V-sling includes at least two flaccid leg members coupled on one end thereof to the load coupling linkage and extending therefrom. The flaccid leg members may be formed by chains, webbing or rope formed of wire or synthetic materials with opposing ends thereof being coupled to one or more hooks for coupling to a vehicle.

V-slings have long been used by tow operators when winching a vehicle, such as for vehicle towing, as when a vehicle must be extricated from a ditch, or for pulling a vehicle 50 onto the bed 72 of a flatbed tilt-tray type tow truck 70, also known as a rollback, as is illustrated in FIG. 1. The V-sling allow the tow operator to easily hook up a winch line 60 to vehicles and pull from the center of the vehicle so that it is pulled evenly and straight as the winch line is wound on the spool of the winch 74. Prior art V-slings are made with longitudinally extending leg members form of chain, as shown in FIGS. 2A and 2B, or synthetic webbing as shown in FIG. 4. V-sling 10, shown in FIG. 2A, is formed by a pear shaped master link 12 to which a pair of chain legs 14 are coupled by corresponding master coupling links 15. The opposing end of each chain 14 is coupled to at least one hook 16, such as a J hook, mini J hook, T hook or R hook, or the like, by a coupling link 28. Often, each chain leg 14 of V-sling 10 will have at least one additional hook 16*a* of a different variety to permit more versatility in coupling the V-sling 10 to vehicles of various manufacturers and models. The multiple hooks 16 and 16*a* may be coupled to each chain 14 by a single coupling link 28 or a coupling link 28 or each hook. The V-sling 10 may also include hooks 18 coupled to the master coupling links 15, which are provided so that the user can shorten the length of the chain legs 14 when necessary for a particular application.

A variation of the V-sling 10 is shown in FIG. 2B. Here, the master link 12' is formed by an oval shaped link rather than a pear shaped link. In all other respects, the V-sling 10' is identical to the V-sling 10. A further variation of the prior art V-slings is shown in FIG. 4. In FIG. 4, the V-sling 10" is formed by a pear shaped master link 12 to which a pair of legs formed by web bodies 20 are coupled by corresponding master coupling eyes 22. The web bodies 20 are typically formed from synthetic material, such as polyamides and polyesters, in the form of single-ply or multi-ply webbing. The opposing end of each leg 20 is coupled to at least one hook 16, which may be a J hook, mini J hook, T hook, R hook, or the like, by a terminal coupling 26 extending through a hook coupling eye 24 of leg 20 and to which a coupling link 28 is connected. As in the V-slings 10 and 10', V-sling 10" may have at least one additional hook 16*a* of a different variety. The V-sling 10" has an advantage over V-slings 10 and 10' in that the web bodies 20 help protect delicate components of the vehicle being winched, such as bumpers, spoilers, oil pans and the like.

For more than thirty years there has been no issue with the use of these prior art V-slings. In recent years, as vehicles have been and continue to be made with lighter materials and with lower ground clearance, damage during winching and towing operations has increased. Vehicle manufactures have also lowered engine components and accessories, such as radiators, relative to the vehicle's frame in order to reduce the height of the vehicle's hood and thereby increase the vehicle's aerodynamics. These changes in the vehicles' design and manufacture have created a situation where the hook of the winch line comes in contact with the delicate vehicle components.

Referring to FIG. 3A, there is shown a vehicle 50 being winched using the V-sling 10. The chain legs 14 are shortened using the hooks 18 to position the hook 62 connected to the winch line 60 away from the vehicle bumper. Although the winch line hook 62 is coupled to the winch line 60 through a pivotal coupling 64, the orientation is controlled by the master link 12 of V-sling 12. The winch line hook 62 is orient in a plane that is substantially orthogonal to the plane of master link 12, which is held in a substantially horizontal plane by the two chain legs 14 extending to the vehicle's side frame members 54. With the winch hook 62 so oriented; it extends into the undercarriage of the vehicle and contacts the radiator. In FIG. 3B, V-sling 10 is hooked to the vehicle 50 with the chain legs 14 extended their full length. The winch hook 62 is coupled to the winch line 60 with an eye 66 integrally formed in the hook in one-piece formation. The same deleterious conditions occur when the V-sling 10' is used in place of the V-sling 10. Although the winch line 60 is capable of twisting to allow the hook 62 to be oriented at any angle, here again, the orientation of the master link 12 controls the orientation of the winch hook 62. In this situation, the orientation of the winch hook 62 places it in contact with the bumper 52 of the vehicle 50.

Turning now to FIGS. 5A and 5B, there are shown similar situations where the V-sling 10" is used. As shown in FIG. 5A, the web bodies 20 are secured to the side frame members 54 of the vehicle 50 and the winch hook 62 is engaged with the master link 12 thereof. The winch hook 62 is coupled to the winch line 60 through a pivotal coupling 64. Here again, the orientation of the winch hook 62 is controlled by the orientation of the master link 12. As such, the height of the winch hook 62 places it into the undercarriage of vehicle 50 where it is able to come into contact with the vehicle's oil pan or other easily damaged components. The only variation the can be made with respect to the angle of winch hook 62 is whether the open (or openable) side of the hook faces upward or downward. In FIG. 5B, the winch hook 62 has its open side facing downward, opposite to that illustrated in FIG. 5A. Here to, the height of the winch hook 62 places it into the undercarriage of vehicle 50 where it is able to come into contact with the vehicle's oil pan. Just as illustrated in FIGS. 5A and 5B, the direction in which of the open side of winch hook 62 faces in the situations illustrated in FIGS. 3A and 3B will have ameliorating effect.

There is therefore a need in the art for orienting the winch hook in a plane that corresponds to the plane of the V-sling's master link. The V-sling structures disclosed herein fulfill that need; providing a solution to the problems associated with the use of prior art V-sling structures with vehicles designed to achieve improved fuel efficiency through the use of low weight materials and improved aerodynamics.

SUMMARY OF THE INVENTION

A V-sling for use in winching a vehicle includes a master linking device having a load coupling linkage and a hook positioning adapter. The load coupling linkage defines a first plane and the hook positioning adapter is disposed in a second plane. The second plane is transverse to the first plane for positioning a hook engaged therewith in a plane corresponding to the first plane. The V-sling further includes at least two longitudinally extending flaccid leg members having opposing first and second ends. Each of the flaccid leg members is coupled on the first end thereof to the load coupling linkage of the master linking device. The V-sling further includes a plurality of hooks respectively coupled to the second ends of the plurality of flaccid leg members.

From another aspect, a V-sling for winching a vehicle includes a master link, and a plurality of longitudinally extending flaccid leg members having opposing first and second ends. Each of the flaccid leg members is coupled on the first end thereof to the master link. The V-sling also includes a plurality of hooks respectively coupled to the second ends of the plurality of flaccid leg members. The V-sling further includes a hook positioning adapter coupled to the master link and disposed in a plane angularly displaced from a plane defined by the master link for positioning a hook engaged therewith in a plane corresponding to the plane defined by the master link.

From yet another aspect, a V-sling for use in winching a vehicle onto a flatbed tilt-tray type tow truck for transport thereon includes a master linking device having a load coupling linkage and a hook positioning adapter. The load coupling linkage is formed by a first closed link disposed in a first plane. The hook positioning adapter is formed by a longitudinally extended second closed link disposed in a second plane. The second plane is transverse to the first plane for positioning a hook engaged therewith in a plane corresponding to the first plane. The V-sling further includes at least two longitudinally extending flaccid leg members having opposing first and second ends. Each of the flaccid leg members is coupled on the first end thereof to the first closed link. The V-sling still further includes a plurality of hooks respectively coupled to the second ends of the plurality of flaccid leg members.

DETAILED DESCRIPTION OF THE PREFERRED EMBODIMENTS

Figure 1:
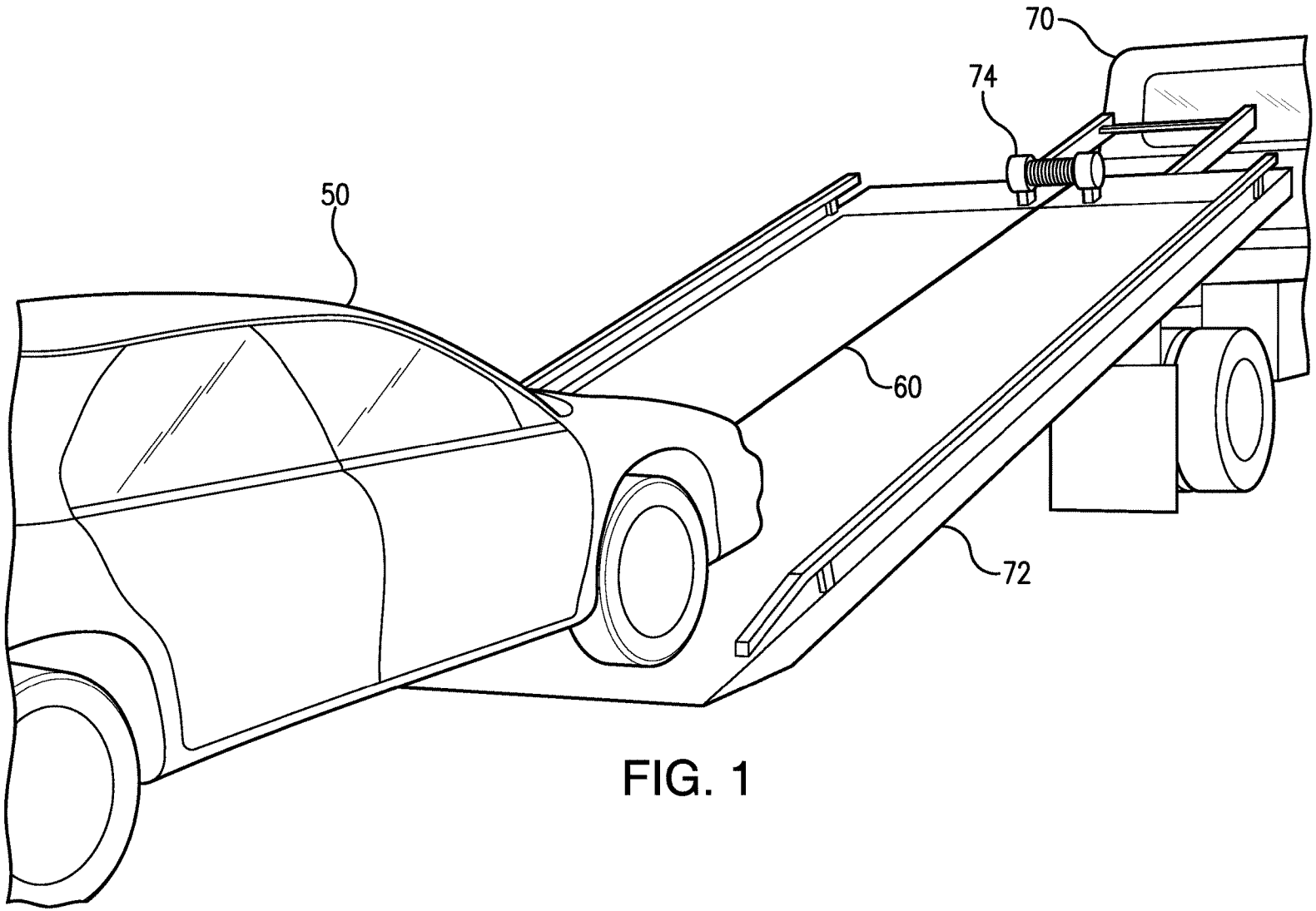
FIG. 1 is an illustration of a vehicle being winched onto a flatbed tilt-tray type tow truck.
Figure 2A:
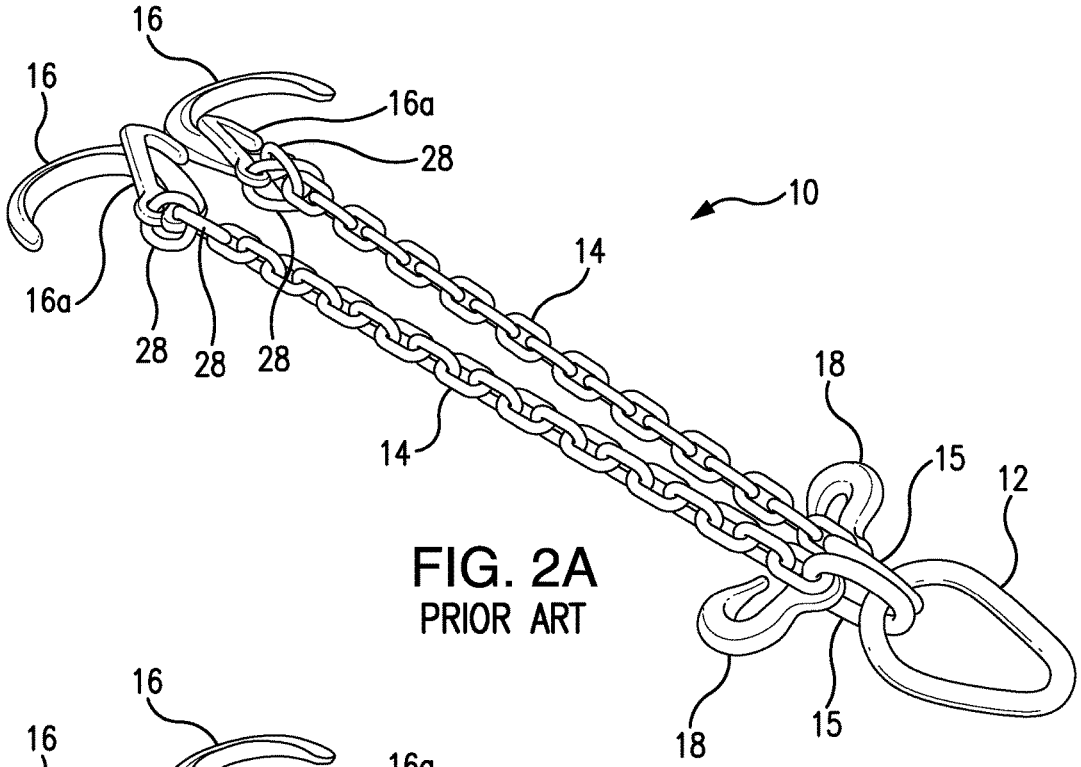
FIG. 2A PRIOR ART
FIGS. 2A and 2B are illustrations of prior art V-slings formed with chain legs.
Figure 2B:
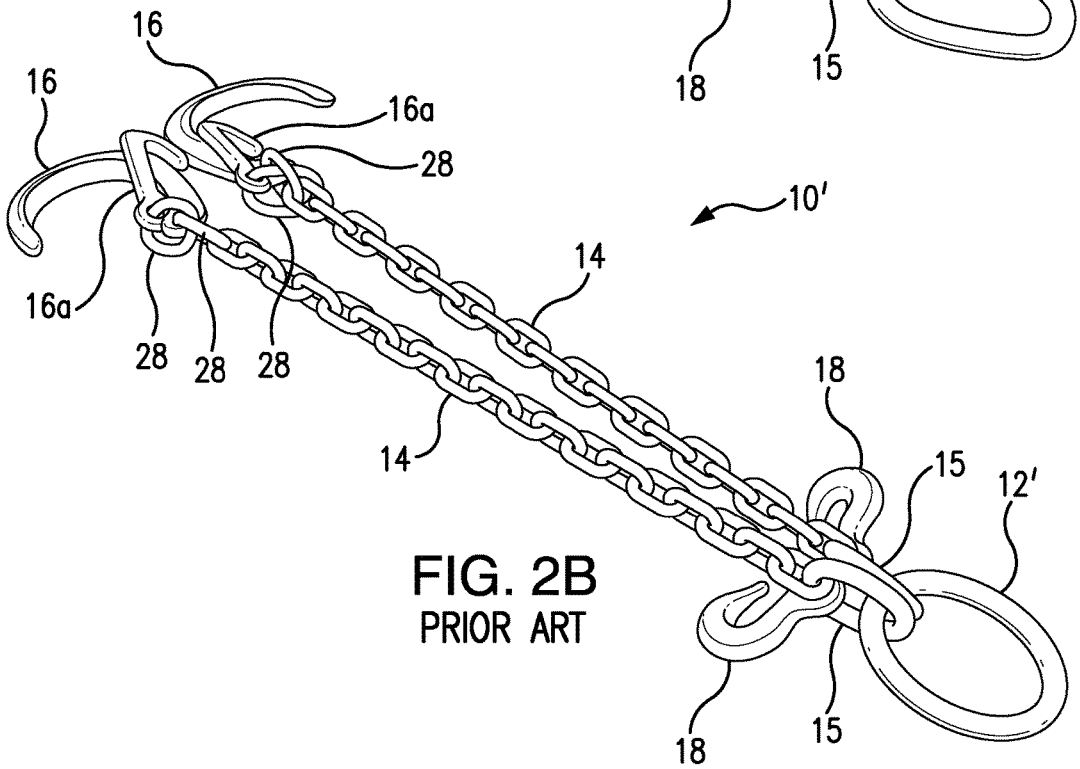
FIG. 2B PRIOR ART
Figure 3A:
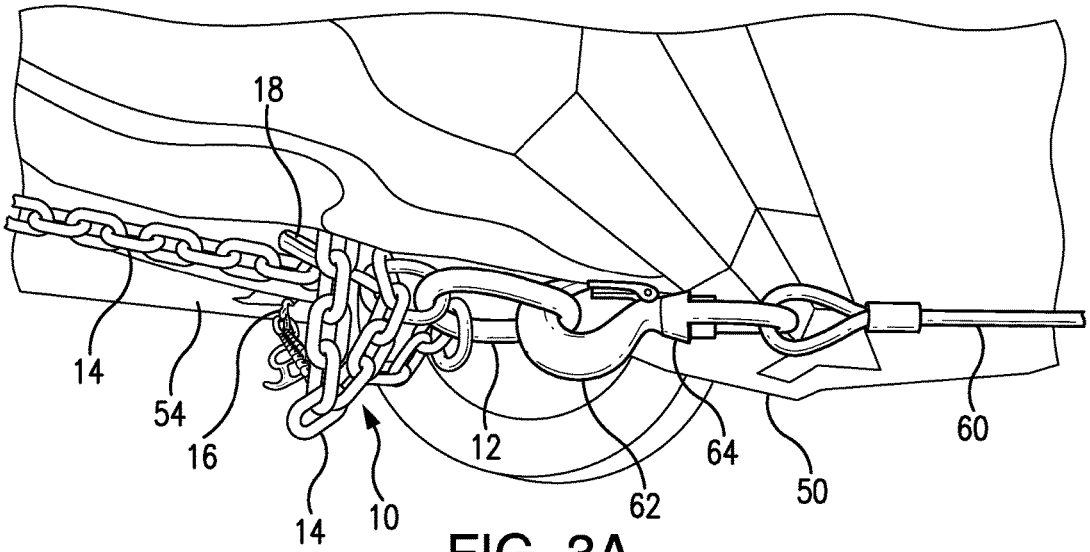
FIG. 3A PRIOR ART
FIGS. 3A and 3B are examples of the use of the V-sling of FIG. 2A.
Figure 3B:
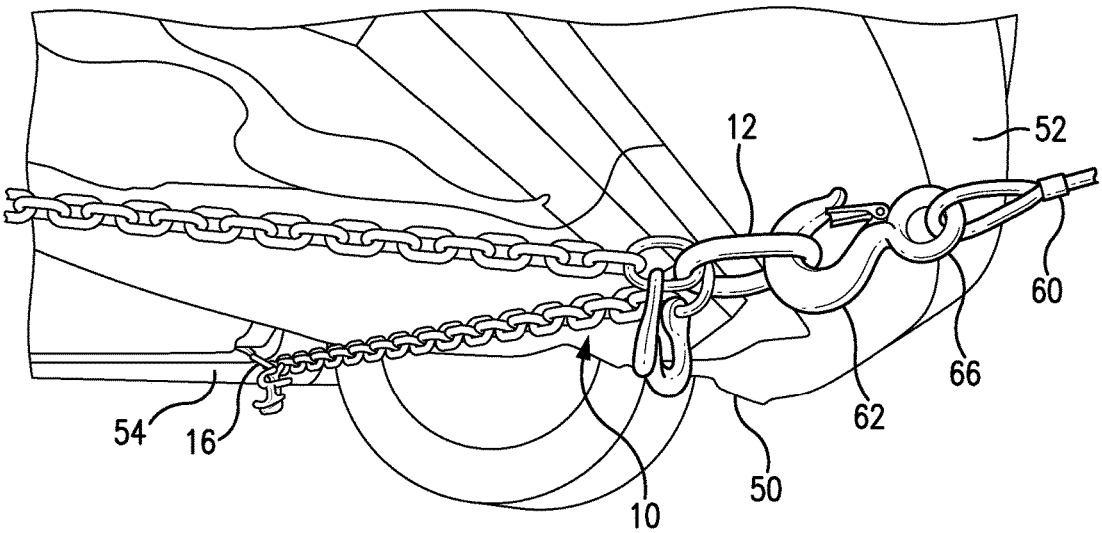
FIG. 3B PRIOR ART
Figure 4:
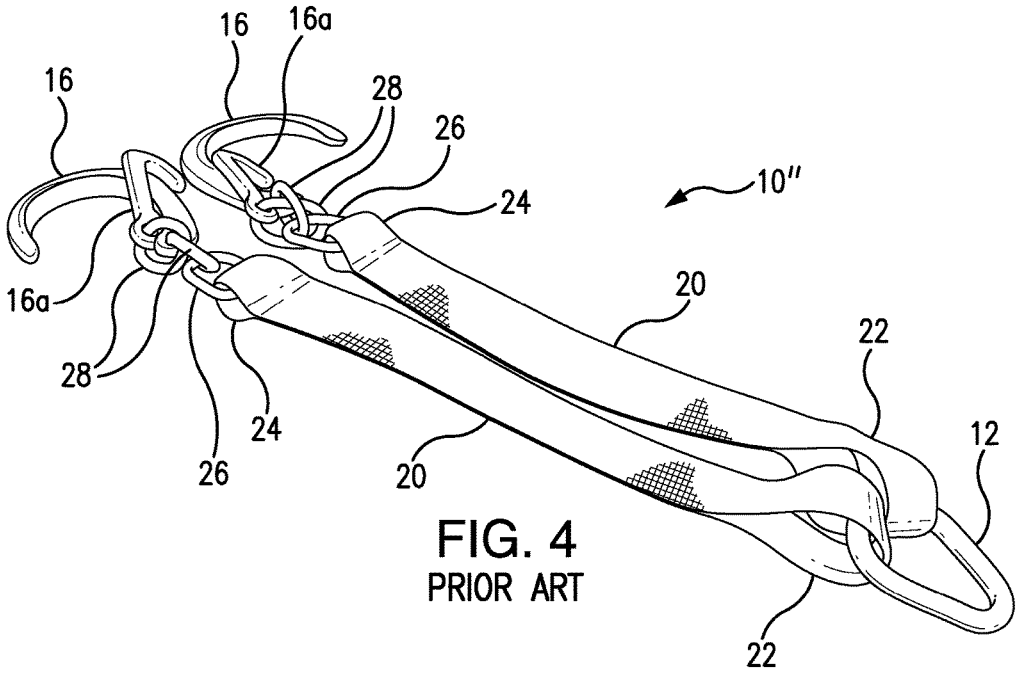
FIG. 4 PRIOR ART
FIG. 4 is an illustration of a prior art V-sling with legs formed of web bodies.
Figure 5A:
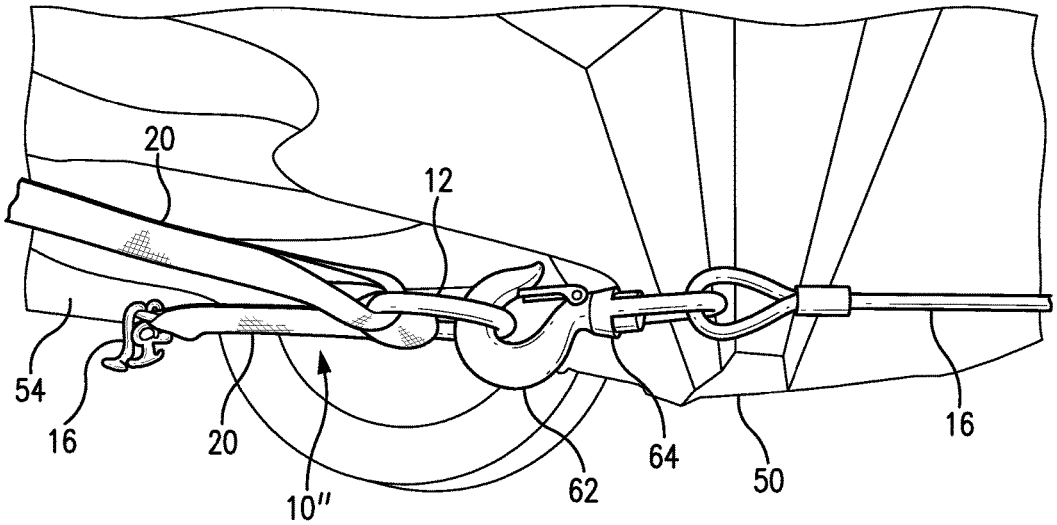
FIG. 5A PRIOR ART
FIGS. 5A and 5B are illustrations of the use of the V-sling of FIG. 4.
Figure 5B:
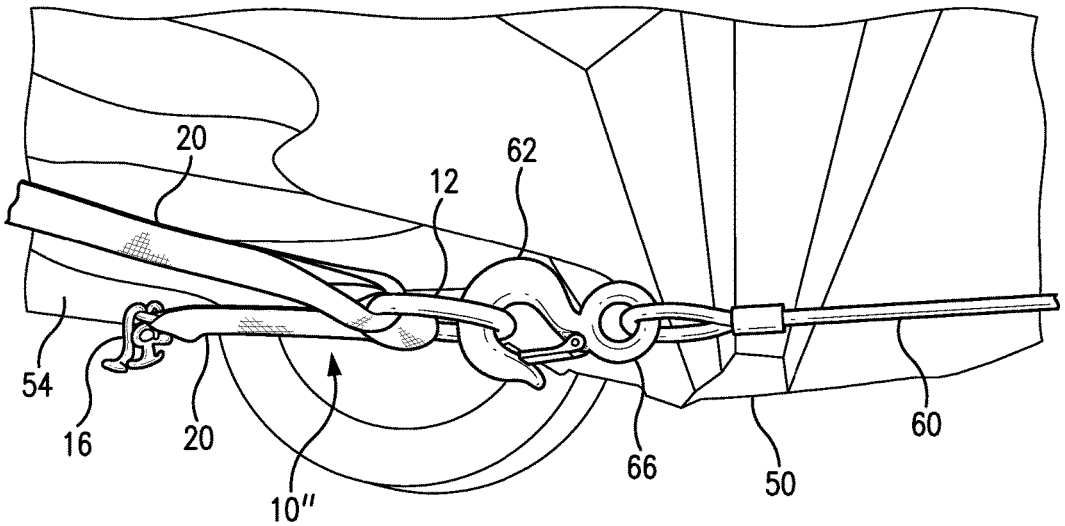
FIG. 5B PRIOR ART

Referring to FIGS. 1, 6A, 6B, 6C, 7A, 7B, 8A, 8B, 8C, 9A, 9B AND 9C there is shown a V-sling 100, 100', the components thereof and the use thereof. The V-sling 100, 100' is coupled between a vehicle 50 and a winch line 60, whereby, for example, the vehicle can be pulled onto the bed 72 of a flatbed tilt-tray type tow truck 70 as the spool of the winch 74 is rotatably driven. V-sling 100, 100' includes a master linking device 150, 150' that is provided with a hook positioning adapter 154, 154' that serves to orient the winch hook 62 in a plane corresponding to the plane established by the load coupling linkage 152, 152*a*, 152' of the master linking device 150, 150'. By that arrangement, the deleterious conditions created by contact between winch hooks and delicate vehicle components using prior art V-slings is prevented.

Figure 6A:
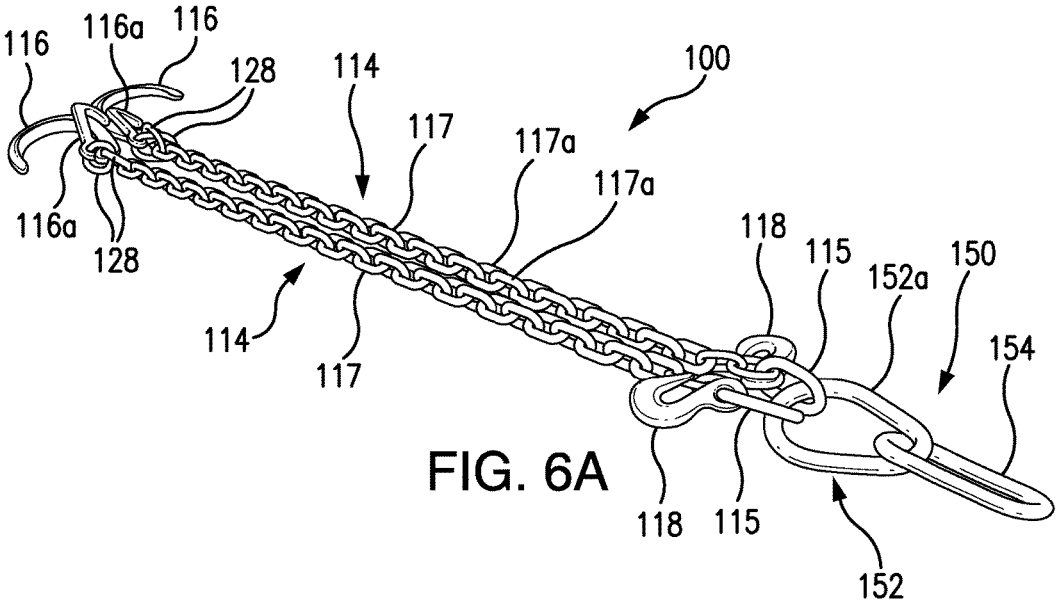
FIG. 6A is an illustration of a V-sling structure incorporating the present invention.

Referring now to FIG. 6A, there is shown V-sling 100 for use by tow operators when winching a vehicle, such as for vehicle towing, as when a vehicle must be extricated from a ditch, or for pulling a vehicle 50 onto the bed 72 of a flatbed tilt-tray type tow truck 70, as shown in FIG. 1. V-sling 100 includes a master linking device 150 that provides the interface with a winch line and is coupled to a pair of longitudinally extended flaccid leg members 114. The flaccid leg members 114 of V-sling 100 are each formed of a chain 117 of interconnected links 117*a*, as is well known in the art. Each leg member 114 is coupled on one end to the master linking device 150 by means of a corresponding master coupling link 115 and on an opposing longitudinal end to a corresponding hook 116 by a respective coupling link 128. Hooks 116 may be any of a J hook, mini J hook, T hook or R hook, or the like.

As is customary for V-slings used in the towing industry, each of the flaccid leg member may have at least one additional hook 116*a* of a different variety than that of hook 116 to permit more versatility in coupling the V-sling 100 to vehicles of various manufacturers and models. The multiple hooks 116 and 116*a* for each leg member 114 may be coupled thereto by a respective one of multiple coupling links 128 or coupled by a single link 128. The master coupling links 115, in addition to joining the leg member 114 to the master linking device 150, may also connect the master linking device 150 to chain shortening hooks 118. Each of the flaccid leg members 114 and the chain shortening hooks 118 may alternately be joined separately to the master linking device 150 by a separate master coupling link. In order to shorten each chain 117 that defines a respective leg member 114, a corresponding the chain shortening hook 118 is engaged with a selected one of the links 117*a* disposed intermediate the opposing ends of chain 117. By the engagement between the chain shortening hook 118 and the selected link 117*a*, the selected link 117*a* is thereby coupled to the master linking device 150, bypassing the chain links 117*a* located between the master linking device 150 and the selected link.

Figure 6B:
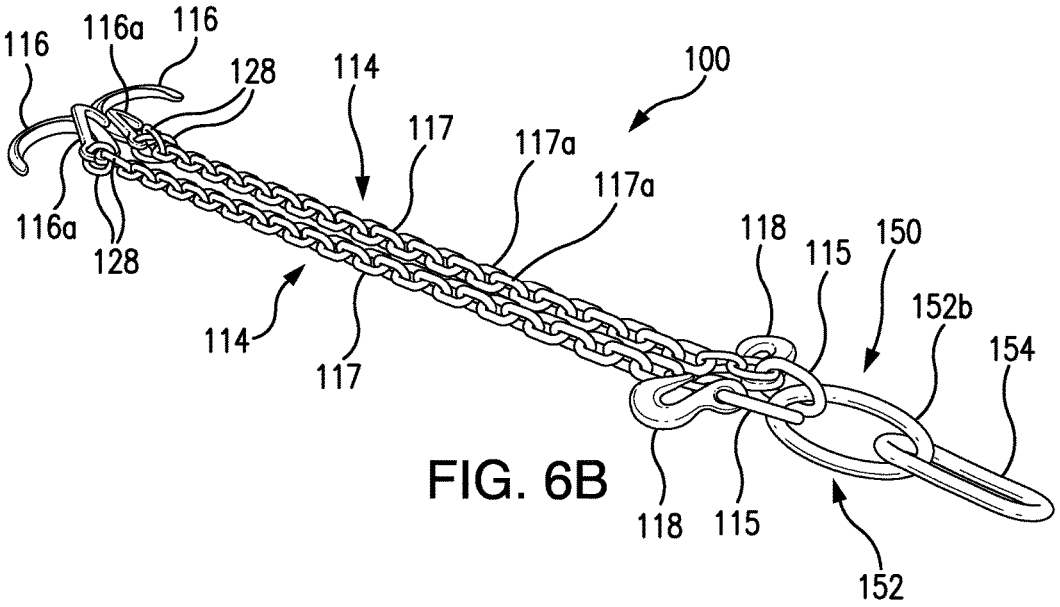
FIG. 6B is an illustration of a V-sling structure incorporating the present invention with the load coupling linkage of the master linking device having an alternate contour.

The master linking device 150 includes a load coupling linkage 152 and a hook positioning adapter 154. Load coupling linkage 152 may have any shape that provides sufficient space for coupling at least two master coupling links, however, a pear shaped master link 152*a*, as shown in FIG. 6A, and an oval shaped master link 152*b*, as shown in FIG. 6B, are commercially available links that have been successfully used in V-sling assemblies. Circular links are also commercially available and although not shown, may be used as well. The hook positioning adapter 154 is a link of sufficient length so that the tow operator can easily engage the hook positioning adapter 154 with the winch hook 62. While an oval shaped link, as shown, is a common contour of links used in towing equipment any other contour is applicable for use as the hook positioning adapter of V-sling 100. Likewise, the width of the hook positioning adapter 154 must be sufficient to be easily engaged by the winch hook 62, but narrow enough to maintain a clearance from the frame of a vehicle. Hook positioning adapters having a length in the approximate range of 3 to 5 inches and a width in the approximate range of 2 to 3 inches have been successfully used in master linking device 150.

Figure 6C:
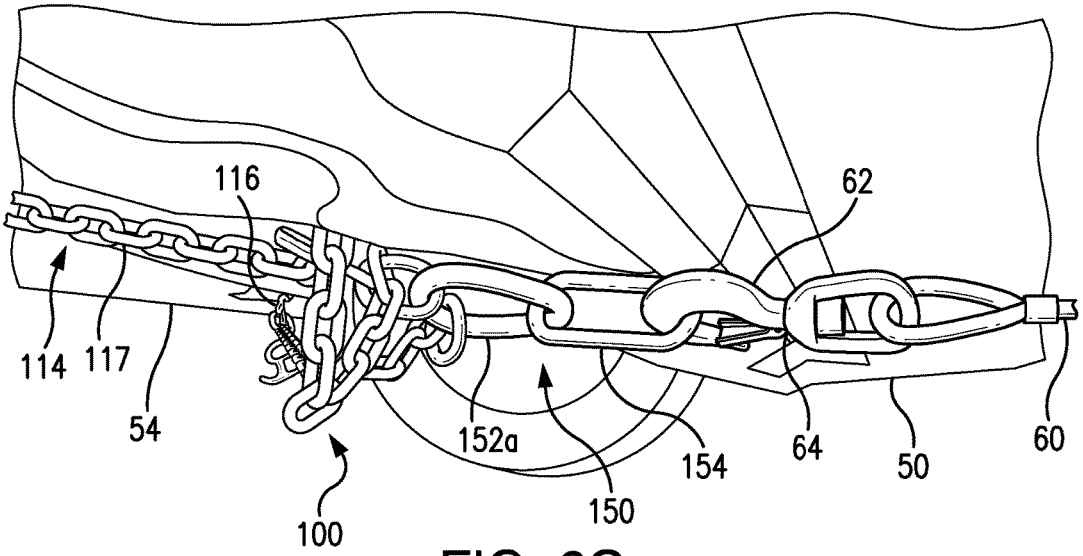
FIG. 6C is an illustration of the present invention in use for winching a vehicle.

Turning now to FIG. 6C, the use of V-sling 100 will be discussed. The hooks 116 are engaged with side frame members 54 located on opposing sides of the vehicle 50 and the flaccid leg members 114 extend from the hooks 116 to the master linking device 150 and more specifically are coupled to the load coupling linkage 152. In the particular arrangement shown, the flaccid leg members 114 are formed by chains 117 and in the situation illustrated they have been shortened in the manner previously described. The winch line 60 is coupled to the winch hook 62 through a pivotal coupling 64. The winch hook 62 is engaged to the V-sling 100 by its coupling to the hook positioning adapter 154 of master linking device 150. The application of tension forces on three points of the master link 152*a*, which defines the load coupling linkage 152 in this case, suspends the master link 152*a* in a plane, a plane which is substantially parallel to the vehicle's frame. The hook positioning adapter 154 is oriented in a plane that is angularly displaced from the plane of the master link 152*a*, and in fact transverse thereto. As the winch hook 62 must engage the hook positioning adapter 154 in a direction that is respectively transverse thereto, the winch hook 62 will be oriented in a plane that substantially corresponds to the plane of the master link 152*a*. Thus, the winch hook 62 is positioned by the hook positioning adapter 154 to have its width, from shank to tip, substantially parallel to the vehicle's frame and thereby spaced away from contact with the undercarriage of the vehicle and any of the delicate structures of vehicle 50.

Figure 7A:
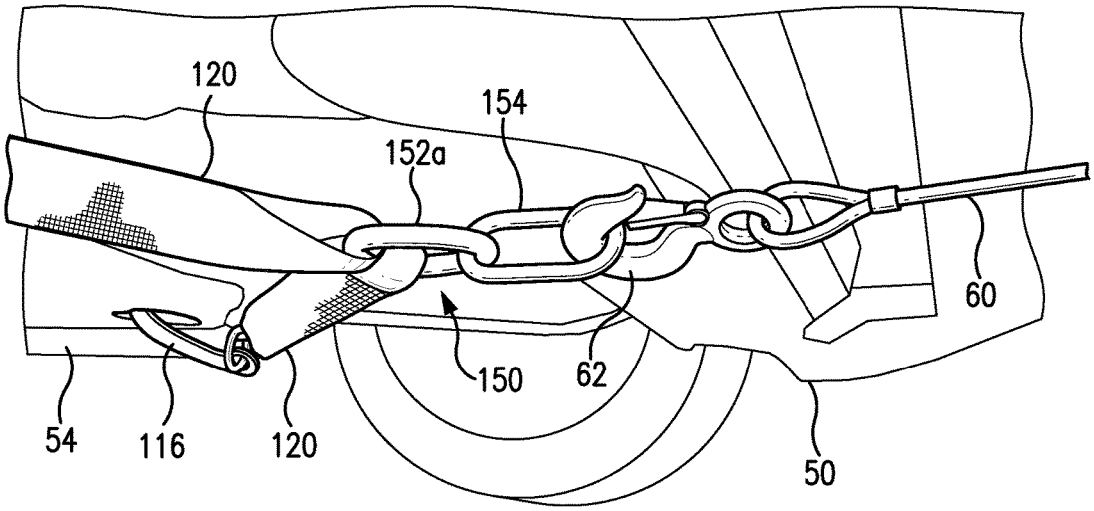
FIG. 7A is an illustration of the V-sling of FIG. 7B in use for winching a vehicle.
Figure 7B:
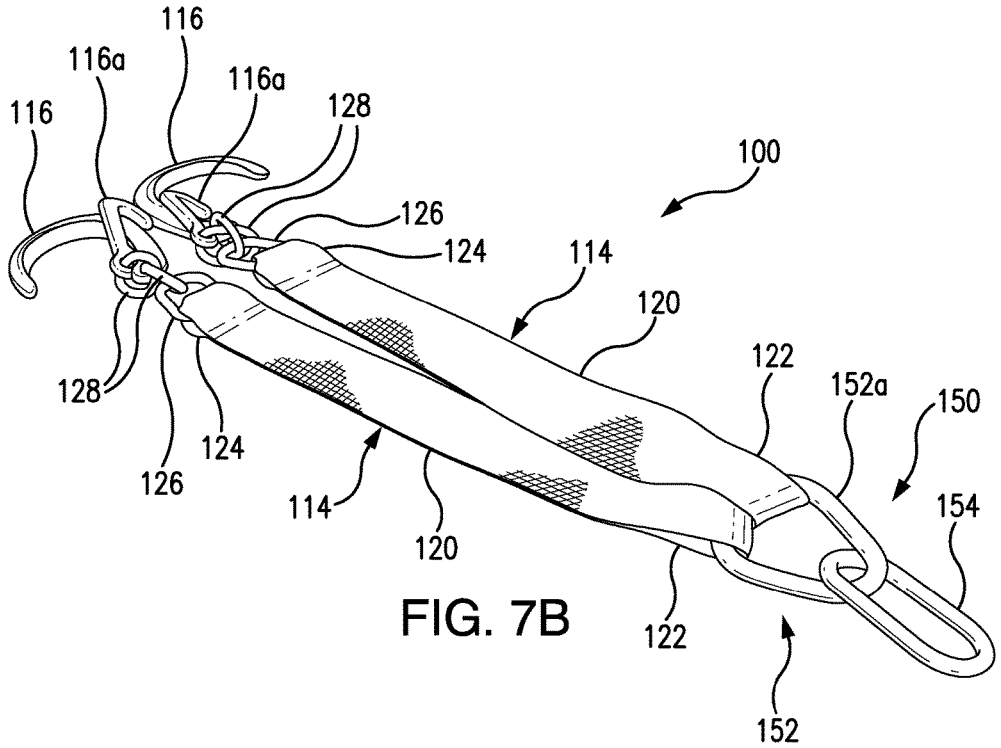
FIG. 7B is an illustration of the of a V-sling structure incorporating the present invention with the legs formed of web bodies.

Referring now to FIG. 7B, there is shown V-sling 100 having a variation in its structure. Here, V-sling 100 has a pair of flaccid leg members 114 formed by web bodies 120 extending from the master linking device 150. Other variations of V-sling 100 are also possible where the flaccid leg members 114 are formed of rope formed of wire or synthetic materials. As is common in commercially available V-slings, each web body 120 is formed from synthetic material, such as a polyamide and polyester materials, in the form of single-ply or multi-ply webbing. Each web body is coupled by corresponding master coupling eyes 122 to the master linking device 150. The opposing end of each web body 120 is coupled to at least one hook 116, which may be any of a J hook, mini J hook, T hook or R hook, or the like. Each web body 120 is coupled to the hook 116 by a terminal coupling 126 extending through a hook coupling eye 124 of web body 120 and to which at least one coupling link 128 is connected. Each web body 120 may have at least one additional hook 116*a* of a different variety connected to the terminal coupling 126 thereof by means of the coupling link 128 securing the hook 116 or another separate coupling link 128.

The master linking device 150 includes a load coupling linkage 152 and a hook positioning adapter 154. Load coupling linkage 152 may have any shape that provides sufficient space for coupling the master coupling eyes 122 thereto. A pear shaped master link 152*a*, has been successfully used in working embodiments of V-sling 100 and thus illustrated as an exemplary contour for master link 152*a*. The hook positioning adapter 154 is shown as an oval shaped link, but may have any contour that meets the length requirement and width limitation previously described.

Referring to FIG. 7A, the use of V-sling 100 with flaccid leg members 114 formed by web bodies 120 is illustrated. The hooks 116 are engaged with side frame members 54 located on opposing sides of the vehicle 50 and the web bodies 120 extend from the hooks 116 to the load coupling linkage 152 of the master linking device 150. The winch line 60 is coupled to the winch hook 62 through an eye integrally formed in one-piece formation in the hook 62. The winch hook 62 is engaged to the V-sling 100 by its coupling to the hook positioning adapter 154 of master linking device 150. As previously described, the application of tension forces on three points of the master link 152*a* suspends the master link 152*a* in a plane that is substantially parallel to the vehicle's frame. The hook positioning adapter 154 is oriented in a plane that is angularly displaced from the plane of the master link 152*a* and is thereby transverse to the plane of the master link 152*a*. As the winch hook 62 engages the hook positioning adapter 154 in a direction that is respectively transverse thereto, the winch hook 62 is thereby oriented in a plane that substantially corresponds to the plane of the master link 152*a*. Therefore, by the structure of master linking device 150, the winch hook 62 is positioned by the hook positioning adapter 154 to have its width, from shank to tip, substantially parallel to the vehicle's frame. Hence, the winch hook 62 is spaced away from contact with the undercarriage of the vehicle and any of the delicate structures of vehicle 50 by virtue of its orientation that is established by the hook positioning adapter 154.

Figure 8A:
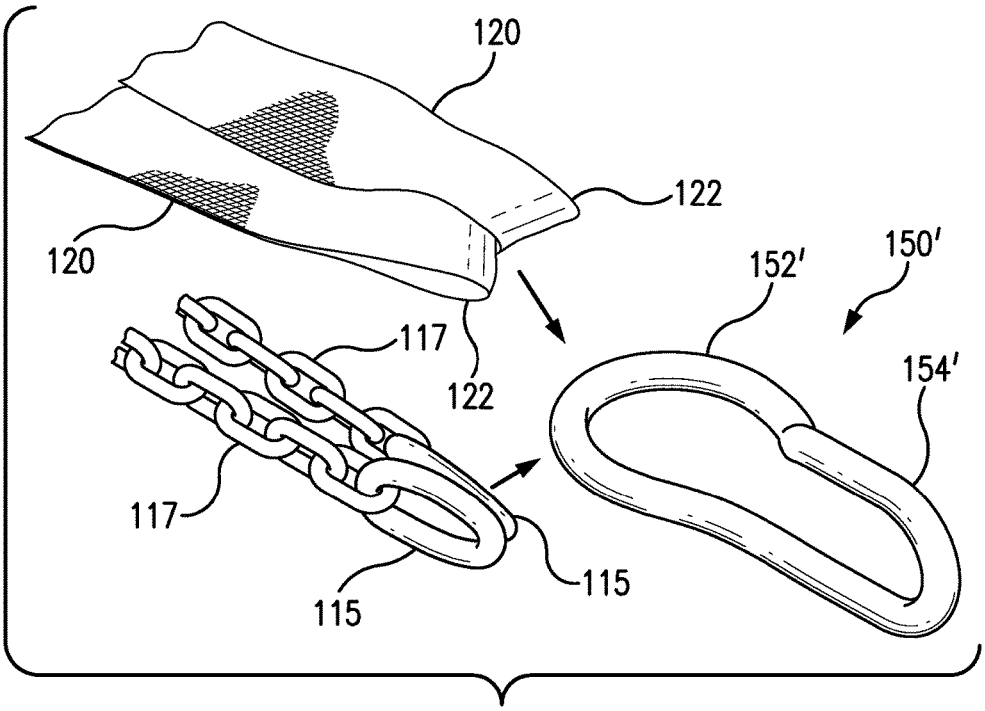
FIG. 8A is an illustration of an alternate structure for the master linking device of the present invention.
Figure 8B:
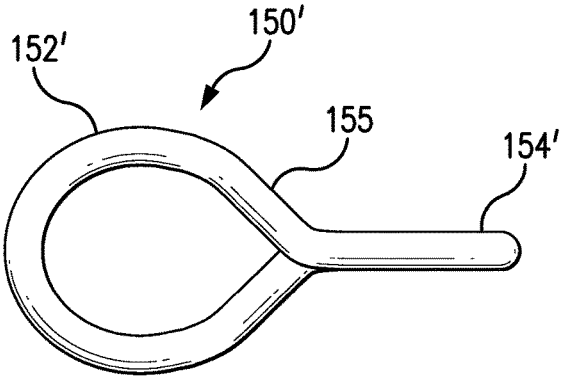
FIG. 8B is an elevation view of the load coupling linkage of the master linking device of FIG. 8A.
Figure 8C:
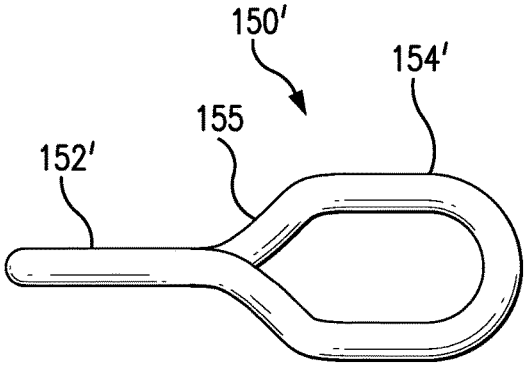
FIG. 8C is an elevation view of the hook positioning adapter of the master linking device of FIG. 8A.

V-sling 100 may include may include a master linking device 150' having a load coupling linkage 152' and a hook positioning adapter 154' formed integrally in one-piece formation, as shown in FIGS. 8A, 8B, and 8C. The master linking device 150' has a substantially pear shaped portion that defines the load coupling linkage 152', as shown in FIG. 8B. The load coupling linkage 152' may have other contours, such as a rounded contour. The substantially pear shaped portion extends to an angular transition portion 155, to change to a longitudinally extended portion extending therefrom at a substantially 90 degree angle to define the hook positioning adapter 154'. The longitudinally extended portion may have substantially parallel sides and may resemble a portion of an oval shaped link, as shown in FIG. 8C, but other contours can function as the hook positioning adapter 154'. In assembly of V-sling 100, the load coupling linkage 152' may be joined the master coupling eyes 122 of web bodies 120 or the master coupling links 115 of the chain 117 that may define the flaccid leg member 114. The master linking device 150' may have a length in the approximate range of 6-9 inches with load coupling linkage 152' and hook positioning adapter 154' being substantially equal in length. The load coupling linkage 152' may have a width in the approximate range of 3 to 4 inches while the width of the hook positioning adapter 154' may have a width in the approximate range of 2 to 3 inches, and narrower than the load coupling linkage 152'. The angular transition portion 155 is a twisted portion of master linking device 150' that angularly offsets the hook positioning adapter 154' with respect to the load coupling linkage 152', so that the hook positioning adapter 154' is disposed in a plane that is transverse with respect to a in which the load coupling linkage 152' is disposed.

Figure 9A:
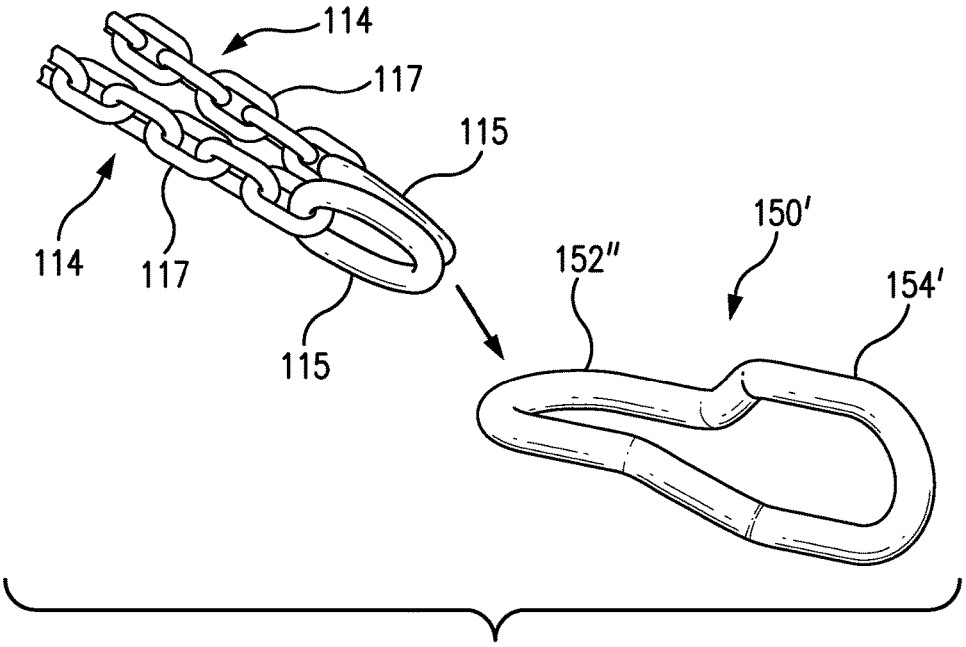
FIG. 9A is an illustration of the master linking device of FIG. 8A with the load coupling linkage having an alternate contour.
Figure 9B:
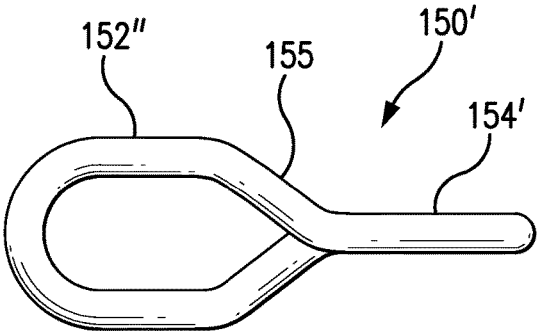
FIG. 9B is an elevation view of the load coupling linkage of the master linking device of FIG. 9A.
Figure 9C:
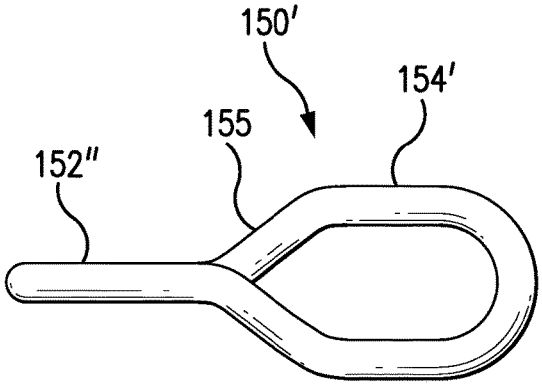
FIG. 9C is an elevation view of the hook positioning adapter of the master linking device of FIG. 9A.

Turning now to FIGS. 9A, 9B and 9*c*, there is shown a master linking device 150' having a load coupling linkage 152" that may resemble a portion of an oval shaped link, but may be of other contours, as is the same for the contour of hook positioning adapter 154'. Master linking device 150' is therefore formed by the load coupling linkage 152" and a hook positioning adapter 154' that are integrally formed in one-piece formation, as shown in FIGS. 9A, 9B, and 9C. The master linking device 150' here is essentially an elongated link with a twisted portion 155 so that the opposing end portions 152" and 154' are offset from one another by a substantially 90 degree angle, as shown in FIGS. 9B and 9C. In assembly of V-sling 100, the load coupling linkage 152" is joined to the master coupling links 115 of the chain 117 that may define the flaccid leg member 114 thereof. The master linking device 150' may have a length in the approximate range of 6-9 inches with load coupling linkage 152" and hook positioning adapter 154' being substantially equal in length and width. The width of load coupling linkage 152" and hook positioning adapter 154' may be in the approximate range of 2 to 3 inches. The angular transition portion 155 as previously described is a twisted portion of master linking device 150' that angularly offsets the hook positioning adapter 154' with respect to the load coupling linkage 152", so that the hook positioning adapter 154' is disposed in a plane that is transverse with respect to a in which the load coupling linkage 152" is disposed.

The descriptions above are intended to illustrate possible implementations of the present invention and are not restrictive. While this invention has been described in connection with specific forms and embodiments thereof, it will be appreciated that various modifications other than those discussed above may be resorted to without departing from the spirit or scope of the invention. Such variations, modifications, and alternatives will become apparent to the skilled artisan upon review of the disclosure. For example, functionally equivalent elements may be substituted for those specifically shown and described, and certain features may be used independently of other features, and in certain cases, particular locations of elements may be reversed or interposed, all without departing from the spirit or scope of the invention as defined in the appended Claims. The scope of the invention should therefore be determined with reference to the description above, the appended claims and drawings, along with their full range of equivalents.

What is being claimed is:

1. A V-sling to be engaged by a hook of a winch line on one end thereof and engaged with a vehicle on an opposing end for use in pulling the vehicle, comprising:

a master linking device having a master link and an adjacent hook positioning adapter, said master link defining a first plane and said hook positioning adapter being disposed in a second plane, said second plane being transverse to said first plane, said hook positioning adapter having an elongated opening configured for receiving an open end of the hook of the winch line, the hook of the winch line being positioned in a plane substantially parallel with said first plane responsive to the open end of the hook of the winch line being engaged with said hook positioning adapter and exerting a tensile force thereon;

at least two longitudinally extending flaccid leg members having opposing first and second ends thereof, each of said flaccid leg members being coupled on said first end thereof to said master link of said master linking device; and a plurality of hooks respectively coupled to said second ends of said at least two flaccid leg members and defining said opposing end of said V-sling;

wherein said master link is tensilely biased to position said first plane defined thereby substantially parallel to a plane defined by an underside of the vehicle and thereby said hook positioning adapter positions the hook of the winch line substantially parallel to the plane defined by the underside of the vehicle.

2. The V-sling as recited in claim 1, where said master link is a first closed link having an arcuate end portion engaged with said at least two flaccid leg members and said hook positioning adapter is a second closed link engaged with said first closed link, said hook positioning adapter having a longitudinally extended contour extending at least 3 inches.

3. The V-sling as recited in claim 2, where said first closed link is a master link having a longitudinally extended oval contour.

4. The V-sling as recited in claim 2, where said first closed link is a master link having a pear or triangularly shaped contour.

5. The V-sling as recited in claim 1, where said master link and said hook positioning adapter are integrally formed in one-piece formation and defining a single closed contour link.

6. The V-sling as recited in claim 5, where said master linking device is a longitudinally extended master link with said master link being disposed at a first end thereof and said hook positioning adapter being defined to extend from an opposing second end of said master link, said master link having a twisted intermediate section disposed between said first and second ends to rotate said second plane relative to said first plane, a width of said master link being at least equal to a width of said hook positioning adapter.

7. The V-sling as recited in claim 6, where said twisted intermediate section is twisted to rotate said second plane approximately ninety degrees relative to said first plane.

8. The towing V-sling as recited in claim 1, where each of said flaccid leg members is formed by a chain.

9. The towing V-sling as recited in claim 1, where each of said flaccid leg members is formed by a strap having a web body.

10. A V-sling to be engaged by a winching hook of a winch line on one end thereof and engaged with a vehicle on an opposing end for pulling the vehicle, comprising:

a master link;

a plurality of longitudinally extending flaccid leg members having opposing first and second ends thereof, each of said flaccid leg members being coupled on said first end thereof to said master link;

a plurality of hooks respectively coupled to said second ends of said plurality of flaccid leg members and defining said opposing end of said V-sling; and a hook positioning adapter located adjacent to said master link and being coupled thereto, said hook positioning adapter being disposed in a plane angularly displaced from a plane defined by said master link, said hook positioning adapter having an elongated opening configured for receiving an open end of the winching hook, the winching hook being positioned in a plane substantially parallel with said plane defined by said master link responsive to the open end of the winching hook being engaged with said hook positioning adapter, said master link being tensilely biased to position said first plane defined thereby substantially parallel to a plane defined by an underside of the vehicle and thereby said hook positioning adapter positions the winching hook substantially parallel to the plane defined by the underside of the vehicle.

11. The V-sling as recited in claim 10, where said hook positioning adapter is a longitudinally extended link engaged with said master link said hook positioning adapter extending longitudinally at least 3 inches.

12. The V-sling as recited in claim 10, further comprising a plurality of coupling links, each of said coupling links being connected to said first end of a respective one of said plurality of flaccid leg members and to said master link to provide coupling therebetween.

13. The V-sling as recited in claim 10, further comprising a plurality of coupling links, each of said coupling links being connected to said second end of a respective one of said plurality of flaccid leg members and to a corresponding one of said plurality of hooks to provide coupling therebetween.

14. The V-sling as recited in claim 13, where said first end of each of said plurality of flaccid leg members is formed in a loop for coupling to said master link.

15. The V-sling as recited in claim 10, where each of said flaccid leg members is formed by a chain.

16. The V-sling as recited in claim 10, where each of said flaccid leg members is formed by a strap having a web body.

17. A V-sling tensilely engaged between a winching hook of a winch line and a vehicle for use in pulling the vehicle onto a flatbed tilt-tray type tow truck for transport thereon, said V-sling comprising:

a master linking device having a master link and an adjacent hook positioning adapter, said master link being formed by a first closed link disposed in a first plane, said hook positioning adapter being formed by a longitudinally extended second closed link disposed in a second plane, said second plane being transverse to said first plane, said hook positioning adapter having an elongated opening configured for receiving an open end of the winching hook, the winching hook being positioned in a plane substantially parallel with said first plane responsive to the open end of the winching hook being engaged with said hook positioning adapter;

at least two longitudinally extending flaccid leg members having opposing first and second ends thereof, each of said flaccid leg members being coupled on said first end thereof to said master link; and a plurality of hooks respectively coupled to said second ends of said at least two flaccid leg members and defining said opposing end of said V-sling;

wherein said master link is tensilely biased to position said first plane defined thereby substantially parallel to a plane defined by an underside of the vehicle and thereby said hook positioning adapter positions the winching hook substantially parallel to the plane defined by the underside of the vehicle.

* * * * *